US006997362B1

(12) United States Patent
Pidcock

(10) Patent No.: US 6,997,362 B1
(45) Date of Patent: Feb. 14, 2006

(54) CANE HOLDER

(76) Inventor: Ralph M. Pidcock, 1011 Buckingham Dr., Allentown, PA (US) 18103

( * ) Notice: Subject to any disclaimer, the term of this patent is extended or adjusted under 35 U.S.C. 154(b) by 0 days.

(21) Appl. No.: 10/066,904

(22) Filed: Feb. 4, 2002

(51) Int. Cl.
*A45F 5/00* (2006.01)

(52) U.S. Cl. ..... 224/607; 224/251; 135/66

(58) Field of Classification Search ..... 135/66; 211/62; 294/157; 224/200, 249, 251, 607, 224/914, 915
See application file for complete search history.

(56) References Cited

U.S. PATENT DOCUMENTS 781,629 A * 2/1905 Ahlstrom ..... 224/915 X
1,243,173 A * 10/1917 Hinckley ..... 211/62
3,958,306 A * 5/1976 Kuusisto ..... 24/73 CS
4,884,730 A * 12/1989 Carpenter ..... 224/162
4,915,279 A * 4/1990 Galbraith ..... 224/230
4,958,758 A * 9/1990 Tipple et al. ..... 224/167
5,323,941 A * 6/1994 Sobolev ..... 224/915 X
5,758,808 A * 6/1998 Epps et al. ..... 224/258
5,906,303 A * 5/1999 Carone et al. ..... 224/251
6,000,414 A * 12/1999 Crusor ..... 135/66
6,062,448 A * 5/2000 Balodis ..... 224/257
6,209,253 B1 * 4/2001 Saldana, Jr. ..... 224/200 X
6,216,319 B1 * 4/2001 Elkins ..... 224/251 X
6,394,329 B1 * 5/2002 Magee ..... 224/678

FOREIGN PATENT DOCUMENTS

CA 2170650 A1 * 8/1997
JP 200060624 A * 2/2000

* cited by examiner

*Primary Examiner*—Sue A. Weaver
(74) *Attorney, Agent, or Firm*—Charles A. Wilkinson; Clinton H. Wilkinson

(57) ABSTRACT

A cane holding device for temporarily holding a cane in close proximity to the body of the user comprising a cane engaging member having at least two interconnected apertures for holding canes of different shapes and sizes, and a lanyard securable around the neck of the user for holding the cane engaging member. The material from which the cane holder is formed is resilient to allow a cane to be pressed from one aperture or orifice in the cane holder to another.

18 Claims, 7 Drawing Sheets

Fig. 9
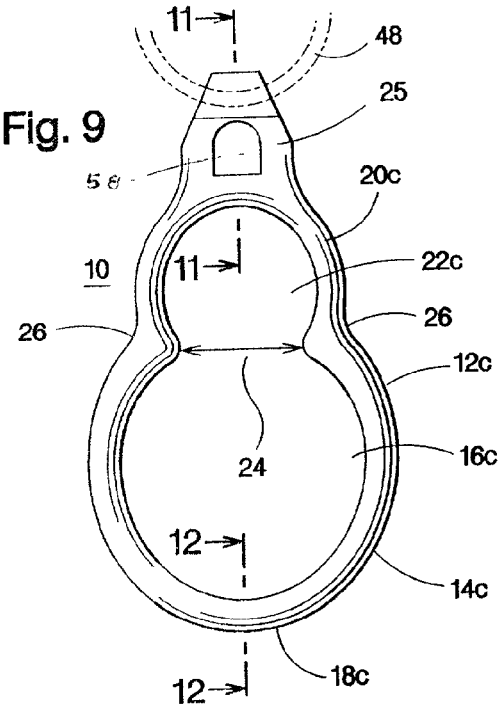
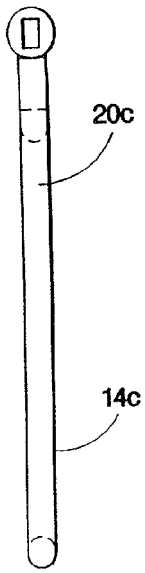
Fig. 10
Fig. 11
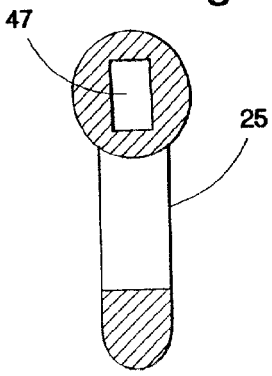
Fig. 12
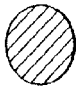
Fig. 17
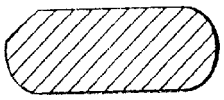
Fig. 13
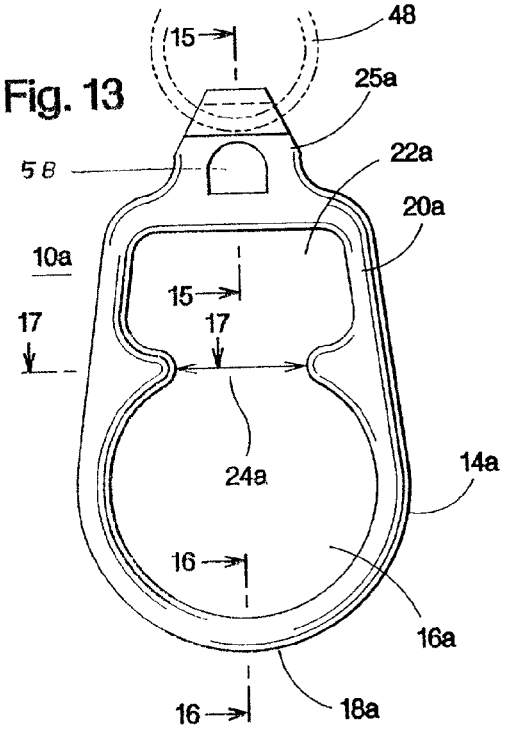
Fig. 14
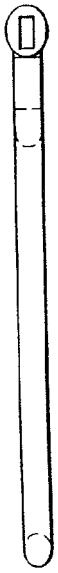
Fig. 15
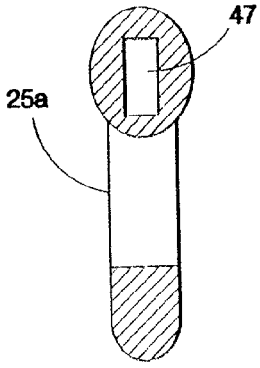
Fig. 16
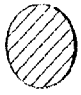

CANE HOLDER

BACKGROUND OF THE INVENTION

1. Field of the Invention

This invention relates to holders for walking canes, and more particularly to a cane holder for securing a cane on or about the person of the user, but which allows the user to have free use of his or her hands when the cane is not in use, and wherein the cane is held on the person of the user within easy reach when needed.

2. Preliminary Discussion

In recent years, the number of persons who might require the assistance of a cane while walking has increased significantly. Such increase is due primarily to the gradual overall aging of the population, which in turn can be attributed in large degree to significant advances in medicine and generally improved living conditions. However, such medical advances have also allowed younger individuals suffering from particular maladies or who are partially incapacitated as a result of an accident or other happening, which persons might otherwise be incapable of walking or moving around at all, to regain at least some of their mobility more quickly than in the past with the assistance of a device such as a cane.

Although canes can be enormously effective in aiding one's mobility by partially transferring the user's weight from the legs to the arms as well as by steadying such person, in effect providing three legs rather than only two, most cane users also find that it is desirable to have a means for quickly and effectively temporarily storing such cane when it is not in use. For example, during times when the user is sitting down or in a resting position, the cane is not required to be used, but preferably should be stored within easy reach of the user for convenient retrieval when such cane is again required for use. However, often there is no convenient or practical place to store or rest the cane within easy reaching distance. If the cane is placed temporarily aside, older users not only may forget where it was placed, but the cane may be precariously placed, and when an attempt is made to recover it, frequently it will be just out of reach or may have been knocked down or over or may have slid to the floor where it can itself constitute a tripping hazard. In addition, many cane users do not have the ability, vision, or range of motion to easily walk, bend, or otherwise move to recover a cane which may have been resting against a wall and fallen to the floor, whereupon it may have become a tripping hazard or danger itself, not only to the user, but to others. Not infrequently, the cane user himself or herself may knock over a standing cane and then have difficulty in recovering it, or even be unable to recover it, from the floor. On the other hand, a cane user often does not wish to hold the cane when it is not required, as he or she wishes to have his or her hands free to perform other tasks, such as preparing food, opening medicine bottles, eating, writing, using the telephone, or sometimes the cane owner simply wants to rest without having to grasp the cane.

While various approaches have been attempted and frequently adopted for either holding a cane nearby the user or in a vertical position or both, there are also a wide variety of sizes, shapes, styles and other structural differences between canes. Often, a user will have several different canes, each having slightly different dimensions. For example, while most canes have a generally rounded shaft, others may have a generally oval or even square or rectangular shape. There is also a wide variance in the types of handles among different canes, as well as differences in the diameters of the shafts of canes. Thus, any holding device for canes must be able to be used on a variety of differently dimensioned canes. Such device should preferably also be able to hold the cane clear of the floor while standing and relatively close to the owner and more or less upright when sitting in order to prevent a tripping hazard.

3. Review of Related Art

A wide variety of straps, slings, lanyards or leashes for carrying or holding items such as bags, fanny packs, skis, canes, umbrellas and the like on one's person or secured to a nearby surface are known in the prior art. The disclosures of the following patents provide a general overview of the kinds of cane holders and similar or related holders that have heretofore been available or devised.

U.S. Pat. No. 439,423 issued to J. B. Potts entitled "Umbrella or Cane Holder" discloses a U-shaped clip which is pinned to the user's garments and wherein the cane is inserted and gripped between the arms of the clip.

U.S. Pat. No. 702,398 issued to E. M. Bowyer entitled "Supporting Device" discloses a snap-type umbrella or parasol holder which in use is secured about the waist of the user by a belt and having elastic loops which are snapped around the umbrella.

U.S. Pat. No. 3,279,663 issued to R. J. Torres entitled "Umbrella and Sling Therefor," discloses a simple adjustable strap having a small ring secured to one end that is hooked over the pointed ferrule on one end of an umbrella, with a snap hook secured to the opposite end of the sling that is clipped to a swivel just above the handle area of the umbrella, creating a sling which can be hung over the shoulder of the user.

U.S. Pat. No. 4,300,742 issued to D. C. Hunn entitled "Cane Holder" discloses a spring clamp device for holding a cane in a vertical position secured to a table or the like, rather than on or attached to the body of the user.

U.S. Pat. No. 4,884,730 issued to C. L. Carpenter entitled "Cane Guard" is designed to help a user recover his or her cane if it is dropped and consists of a hook-and-loop type fastener and rubber O-ring which are affixed around the shaft of a cane and a retractable chain secured around the waist or belt of the user.

U.S. Pat. No. 4,958,758 issued to J. E. Tipple et al. entitled "Multi-Looped Cane Retaining Strap," discloses a strap which is secured to the wrist of the user by a hook-and-loop type wrap and having a flexible leash that is looped around the shaft of a cane and is adjustably tightened by a crimping-type fastening means.

U.S. Pat. No. 5,431,319 issued to M. Cavadini et al. entitled "Holder for a Coin Cup" discloses a strap which is looped around the neck of the user and attached to a circular platform for holding a coin cup used in casinos while playing slot machines and the like.

U.S. Pat. No. 5,622,292 issued to P. Dorney entitled "Detachable Strap for a Plastic Yard of Ale," comprises a shoulder strap or lanyard having a hook-and-loop type fastener on one end for removably securing to an ale glass.

U.S. Pat. No. 5,758,808 issued to R. P. Epps et al. entitled "Cane Positioning Strap," discloses a strap for holding a cane or similar article in a vertical position when not in use, comprised of an adjustable sling strap and a hook-and-loop or snap type retaining strap. While Epps et al. provides a strap for holding a cane over a chair or arm of the user until it is needed, such reference does not disclose a cane-engaging member similar to the present inventor's.

Other devices, such as U.S. Pat. No. 5,826,605 issued to W. W. Hilton entitled "Impact Responsive Extendible Arm Pick-Up for Walking Cane or the Like" are designed to facilitate raising a fallen cane or crutch to an upright position, rather than preventing such cane from falling. In Hilton, an arm member attached to the cane automatically extends or pivots upwardly when the cane or crutch is dropped so that the owner can simply grab the arm and pull the cane up without bending to retrieve the cane.

U.S. Pat. No. 5,964,385 issued to W. H. Simon entitled "Cane Retrieval Device," discloses a retractable cord attached to the wrist of the cane user and secured near the curved holding area of the cane. Such device, however, requires that a housing be attached to the wrist of the user, which is both inconvenient and uncomfortable.

U.S. Pat. No. 6,000,414 issued to J. B. Crusor entitled "Cane Holding Apparatus and Method," discloses a holding device wherein a hook-and-loop type material is attached to the cane and a flexible panel attached to the belt of the user so that the cane is detachably held to the belt panel.

Despite the wide variety of straps and slings known in the prior art, none of such devices addresses the problem of holding or carrying and positioning differently sized and shaped canes when not in use in the same manner as the present invention. Furthermore, there is still presently a need for a device for holding canes that can be temporarily held in a vertical position in close proximity or reach of the user with the cane well above the floor when standing, plus preferably secured to one's person most preferably in a manner that maintains the cane reasonably upright and within close reach of the user when sitting or reclining.

OBJECTS OF THE INVENTION

A primary object of the invention is to provide a convenient means for temporarily holding a cane so that the owner's hands are free to perform various everyday tasks.

A still further object of the invention is to provide a cane holder wherein the cane is held in close proximity to the owner so that it is quickly available when needed.

A still further object of the invention is to provide a cane holder wherein the cane is temporarily secured via the cane holder to a lanyard around the neck of the owner or user, thus avoiding inadvertent loss or misplacement of the cane.

A still further object of the invention is to provide a cane holder wherein the cane is temporarily secured via the cane holder around the neck of the owner or user so the cane is held clear of the floor while standing.

A still further object of the invention is to provide a cane holder that is adapted to easily hold canes of various shapes and diameters.

A still further object of the invention is to provide a cane holder that is attractive, durable, and is also inexpensive to manufacture.

A still further object of the invention is to provide a cane holder incorporating at least two interconnecting cane-retaining orifices as well as being constructed from a semi-flexible composition that facilitates various alternative modes for securing such cane.

A still further object of the invention is to provide a cane holder made of a strong but resilient material that allows the holder to adapt to and retain a variety of canes.

A still further object of the invention is to provide a method of handling a cane in conjunction with a cane holder that allows one or more of a variety of canes to be conveniently kept with the user during non-use.

A still further object of the invention is to provide a cane holder having physically interconnecting openings of disparate size allowing a cane to be entered first into a larger opening and then moved into a smaller opening providing a more secure retention of the cane.

A still further object of the invention is to provide a cane holder having interconnecting disparate shaped openings wherein the holder is formed from a strong resilient material that may be deformed to allow a cane to be pressed into an opening or moved between two openings while temporarily deforming the holder material between the openings.

A still further object of the invention is to provide a cane holder having interconnecting openings of disparate sizes which holder is formed from a strong resilient material that will allow reasonably sized cane heads to be urged or forced through an appropriate opening and then the shaft of the cane to be moved to a smaller opening appropriate to either retain the shaft of the cane by substantially surrounding said shaft or more preferably to actually grip the sides of the cane by resilient compression.

Still other objects and advantages of the invention will become clear upon review of the following detailed description in conjunction with the appended drawings.

SUMMARY OF THE INVENTION

A novel cane holding device is designed to make a cane available for immediate use by a cane user while maintaining the user's hands free to perform other tasks when the cane is not required. In the invention, the cane is secured by a holding device to a lanyard or short cord preferably around the neck of the user. The holding device is made from a pliable resilient rubber or plastic material which is easily forced around the cane and in which the cane is held in place. The exact design or nature of the holding device may depend on the contour or shape of the cane. However, the cane holder is designed to accommodate in any one embodiment a variety of shapes and sizes of canes. The holding device has a first or larger opening or orifice into or through which the cane head or handle is first slipped, and a second or smaller interconnecting opening or orifice into which the cane shaft can then be squeezed or forced from the larger opening or orifice through the interconnecting channel between the larger and smaller openings or orifices to more securely hold the cane. A larger cane may remain in the larger opening or orifice. The cane holder is temporarily secured to or held on or positioned with respect to the body of the user above the waistline of the user so that the cane does not touch the floor when the user is standing and does not otherwise become a tripping hazard either when standing or sitting. To remove the cane from the holding device, the cane shaft may be squeezed back into the larger opening or orifice and the cane then slipped out of the holding device. The cane holder of the invention is, therefore, to a large extent a single device that because of its adjacent interconnecting openings, or orifices, as well as its resilient nature, is readily adaptable to securely holding a variety of cane designs in various suitable orientations within the holder depending upon the relative size and shape of both the holder and cane.

BRIEF DESCRIPTION OF THE DRAWINGS

FIG. 9 is an elevation of the alternative embodiment of the invention shown in FIGS. 3 and 4.

FIG. 10 is a side view of the alternative embodiment of the invention shown in FIG. 9.

FIG. 11 is a cross section of the alternative embodiment cane holder along Section 11—11 of FIG. 9.

FIG. 12 is a cross section of the alternative embodiment cane holder along section 12—12 of FIG. 9.

FIG. 13 is an elevation of a less preferred embodiment of the cane holder of the invention in accordance with the invention wherein the upper portion of the holder including the upper opening has a more rectangular configuration.

FIG. 14 is a side view of the embodiment of the cane holder of the invention shown in FIG. 13.

FIG. 15 is a sectional view of the construction of the cane holder at section 15—15 in FIG. 13.

FIG. 16 is a sectional view of the cane holder construction at section 16—16 in FIG. 13.

FIG. 17 is a sectional view of the construction of the holder at section 17—17 in FIG. 13.

DESCRIPTION OF THE PREFERRED EMBODIMENTS

Figure 1:
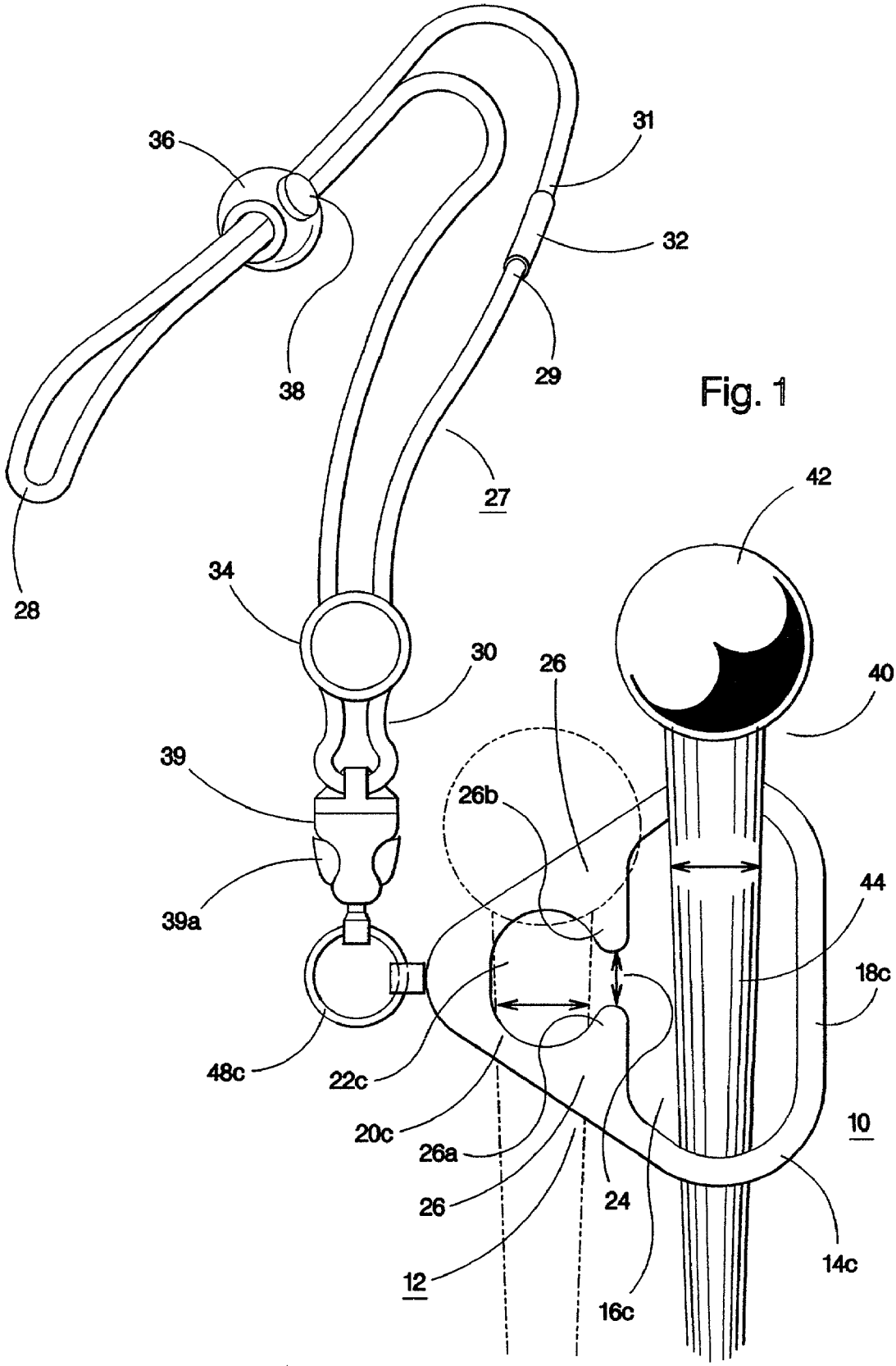
FIG. 1 is an isometric view of a preferred embodiment of the cane holder of the invention with a cane in the process of being placed in such holder as well as shown in broken lines already placed in the holder.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

The cane holder of the invention essentially provides an essentially closed ring arrangement into which a cane, whether a conventional walking stick having a curved upper portion serving as a handle, an English cane having a separate angled cross piece at the top serving as a handle, or a so-called swagger stick type cane having a bulbous grasping or hand hold portion at the top, can be slipped or thrust for retention until needed for support during walking or the like. The holder of the invention is adaptable to nearly every size and shape cane, as well as surface characteristic of canes whether knurled or smooth surfaced and also to varying combinations of handles and shafts and the like. The holder arrangement can be attached to the body of the user in various suitable manners but is preferably secured to or worn from a lanyard which preferably goes around the neck but can pass over or around some other portion of the body of the user.

The cane holder of the invention, while related generically to a basic ring-type holder, sometimes used for support of the scabbard of a bayonet or the like, is significantly more sophisticated, since, instead of being provided with a single orifice, there are at least two separate different diameter orifices adjacent to each other with a restricted dimension access channel or transverse opening between such orifices. This allows a cane to be slid into the larger opening and then moved through the access channel or connecting opening into the smaller orifice or opening in which it may be better held or retained. The cane holder of the invention is, furthermore, preferably formed of a resilient material such as low density polyethylene plastic that normally retains its shape, but can be deformed by a steady force allowing a cane shaft of a larger size than the transverse opening between adjacent orifices to be forced through such opening either into or out of the smaller orifice of the holder. Other suitable materials such as a smooth surfaced rubber could also be used. The resilience of the material of the holder also allows the inside surfaces of the holder to be physically stretched and forced over the head of a cane rather than having to pass the shaft of the cane all the way through the orifice from the other end. In such instance the orifice or opening of the holder is stretched over the head of the cane and then constricts around the shaft. The stiffness of the material is great enough to prevent deformation by any normally or likely application of accidental force and consequent slipping of the cane from the holder. A steady deliberate force, however, will temporarily deform the plastic so that a cane can either be forced from one orifice into a smaller orifice, or the larger orifice can be forced over the head of a cane where such head is too large to slip through the larger orifice, and it is not desired to slip the cane into the orifice from the lower end. The combination of having at least two interconnected orifices in the holder plus construction of such holder from a stiff yet deformable and resilient material provides a very effective and adaptable cane holder that can accept a variety of canes of different designs and diameters. Furthermore, varying the sizes of the orifices adapts the cane holder to alternative varieties and sizes of canes. Thus, a set of three separate cane holders constructed in accordance with the invention with progressively larger openings from the smallest to the largest holder will provide a suitable cane holder for almost any conceivable cane. In addition, the invention is not limited to having only two orifices in the cane holder, but could also incorporate more than two interconnecting orifices such as, for example, three orifices of varying size, four orifices of varying size or the like. Such interconnecting orifices can also be arranged in varying ways, for example, in a three orifice cane holder with two of the orifices interconnecting with the third, or alternatively with the orifices interconnecting in serial order. It is preferred, however, for there to be only two orifices, since two orifices are sufficient, particularly when combined with the flexibility of the holder material, to adapt to a variety of canes. Furthermore, a two-orifice holder will then be inherently smaller and more compact, providing a neater appearance and requiring less attention when using. For example, when there are more than two orifices, more attention will have to be given to placement of a cane in the correct orifice and then moving it to an adjacent smaller orifice, or even, if the cane is of suitable size to be both initially deposited or placed into one orifice and also retained in such orifice, to pick the most suitable orifice. Thus it is usually more convenient to have a cane holder in accordance with the invention with only two or at most three interconnected orifices, but in accordance with the invention it could have from two to a significant number of orifices arranged in some suitable interconnecting order.

Referring to FIG. 1, a cane holder 10 in accordance with the invention for temporarily holding or supporting a cane is shown in isometric projection. The holder 10 per se includes a generally arcuate cane-engaging outer member 12, shown in more detail in FIG. 5, comprising a generally arcuate member or section 14 surrounding or defining a generally elongated arcuate opening or orifice 16 within or adjacent to its outer or "lower" end or section 18, all as shown best in FIG. 5, combined and interconnecting with a generally smaller arcuate member or section 20 surrounding or defining a second smaller more nearly circular arcuate opening or orifice 22 adjacent to and interconnected with opening or orifice 16. Both openings 16 and 22 are dimensioned to receive and demountably support a cane, or more particularly the shank or shaft of a cane, within their circumferences, i.e. in interior openings or orifices 16 and 22. The two generally arcuate cane engaging outer ring members 14 and 20 are connected to each other on opposite sides at 26, and the two openings or orifices 16 and 22 interconnect through short restricted passage 24 between inwardly protruding side sections 26*a* and 26*b*. It will be noted that side sections 26*a* and 26*b* not only project inwardly to form the interconnecting restricted passage 24, but also the side sections 26*a* and 26*b* have an increased bulk or mass which serves to stiffen this portion of the cane-engaging outer member 12 of the holder 10. These heavier sections in effect "beef up" the outer member 12 of the holder at this point so passage of a walking cane shaft through the interconnecting passage 24 is resisted more strongly.

Holder 10 also particularly includes as a substantially integral part thereof a lanyard 27, see FIG. 1, generally having an upper or outer end 28 and lower or inner end 30, such lanyard 27 being of sufficient length to fit over the head and around the neck of the user or wearer of the cane holder of the invention. Lanyard 27 can be made from a variety of materials such as leather, polypropylene, or other flexible plastic, but is preferably made from woven nylon or other similar plastic material. First and second ends 29 and 31 of lanyard 27 are joined together by a compression fitting 32, although other suitable fastening means or fittings may also be used. Although the lanyard 27 can be slipped over the head of the wearer, a means for detachably connecting such lanyard 27 is also preferably provided, such as by the plastic slip connection formed by the compression fitting 32 comprising a resilient plastic sleeve into which the ends 29 and 31 of the lanyard may be slipped or forcibly inserted. The compression of the sleeve 32 is sufficient to normally hold the ends of the lanyard in place or together, but not sufficient to prevent one or both ends from being released if a sufficient force is exerted, for example, if the lanyard should become snagged upon some object. A second more loosely fitted compression fitting 34, which may be forcibly slidable on the lanyard, serves to keep the lower portions of the lanyard together and an upper spring loaded pinch clamp 36 having a threaded tightening means or screw 38 can be used to adjust the length of the loop in the lanyard 27 so that it goes over the user's head and around his or her neck, but is not too loose. The spring loaded pinch clamp 36 in particular, therefore, serves to, in effect, adjust the length of the lanyard both for passage over the head of the user and to adjust how low the cane holding fitting 10 will be supported upon the user. A releasable snap fitting 39 preferably attaches to the end of the lanyard as well as to a support ring 48*c* attached to the cane holder 10. As well known in the art, compression of the snaps 39*a* serves to release the two sections of the releasable snap fitting 39. Where the lanyard does not require any adjustment as to length such as when it is used by a fairly good-sized man, the adjustable pinch clamp 36 may be dispensed with.

Figure 2:
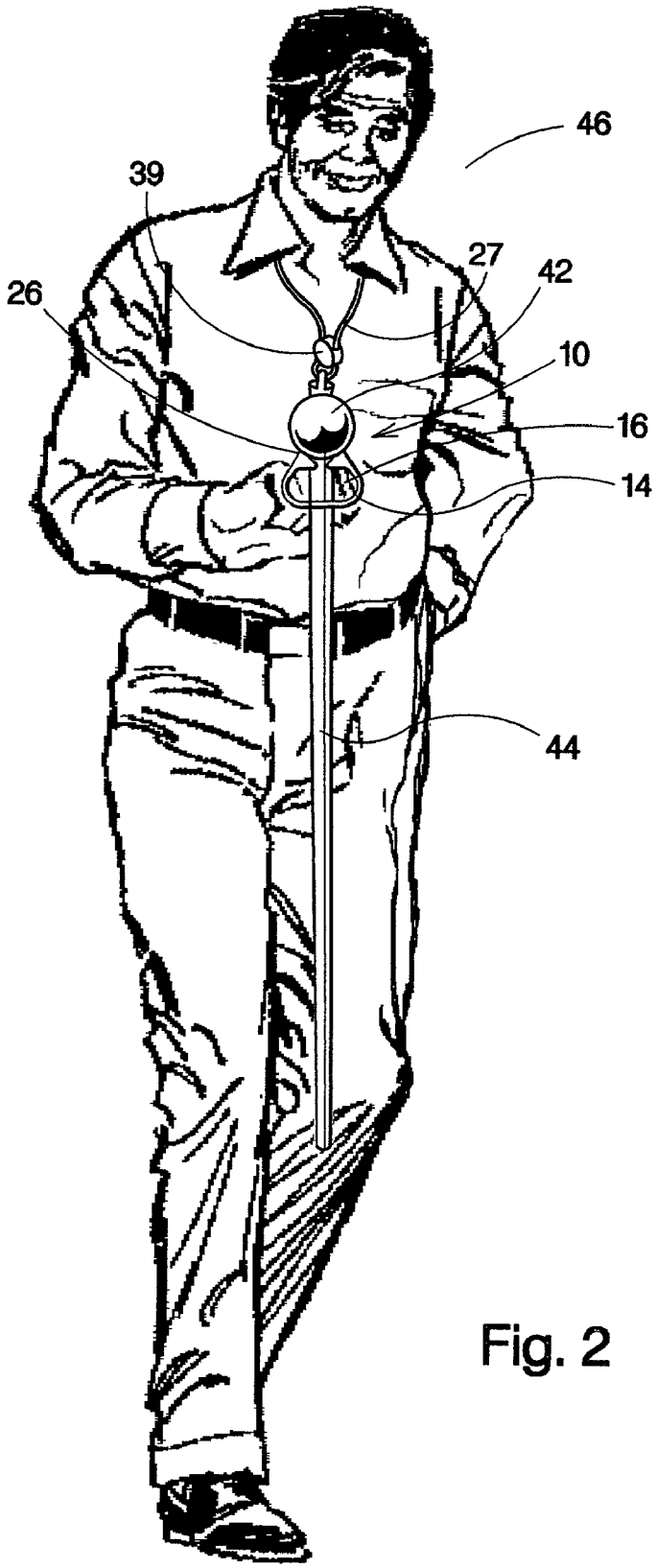
FIG. 2 is an isometric view of the cane holder shown in FIG. 1 in use by or being worn by a cane user with a cane being supported by such holder while the user is in a standing position.

FIG. 2 shows the lanyard 27 and cane holder 10 being worn by a user 46 in a standing or slowly walking upright position. The cane holder 10 is more or less dependent from the lanyard 27 and the cane is positioned in the upper or smaller orifice 22 of the cane holder effectively supporting the cane, since the head is too large to pass through the smaller orifice 22 and the shaft 44 of the cane is also too large to pass through the interconnecting opening 24 (see FIG. 1) between the inwardly projecting side sections 26*a* and 26*b* of the outer ring 12 of the cane holder. In order to remove the cane its shaft will be first pressed through the interconnecting opening 24 between the resilient inwardly projecting side extensions 26*a* and 26*b* (see FIG. 1) into the large opening 16, at which point the resiliency of the cane holder material allows the cane head 42 to be moved or pressed downwardly through the orifice 16 or, if the user prefers, the cane can be merely lifted upwardly until the end of the shaft clears the ring 14. Of course, if the head 42 is in fact smaller than the transverse or minor width of the orifice or opening 16, the cane holder ring 14 will merely be slipped past or over the head 42 of the cane 44. Alternatively, if the head 42 of the cane is not too large, it can be forced through the orifice 16 by forcibly expanding or deforming the flexible material of the ring 14 portion of the cane holder 10.

Figure 3:
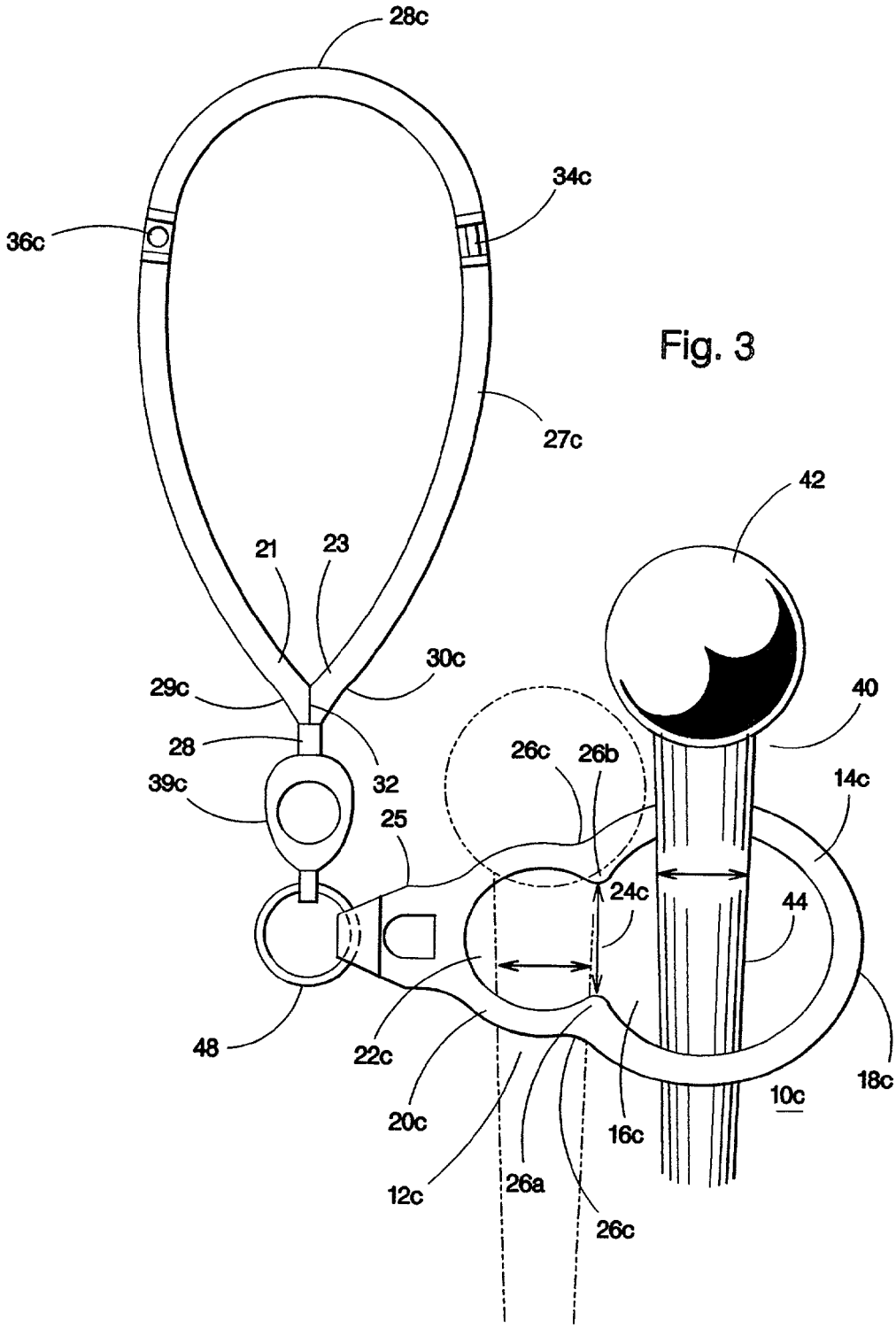
FIG. 3 is an isometric view of an alternative embodiment of the cane holder of the invention with a cane in the process of being placed in such holder as well as in broken lines already placed in the holder.
Figure 5:
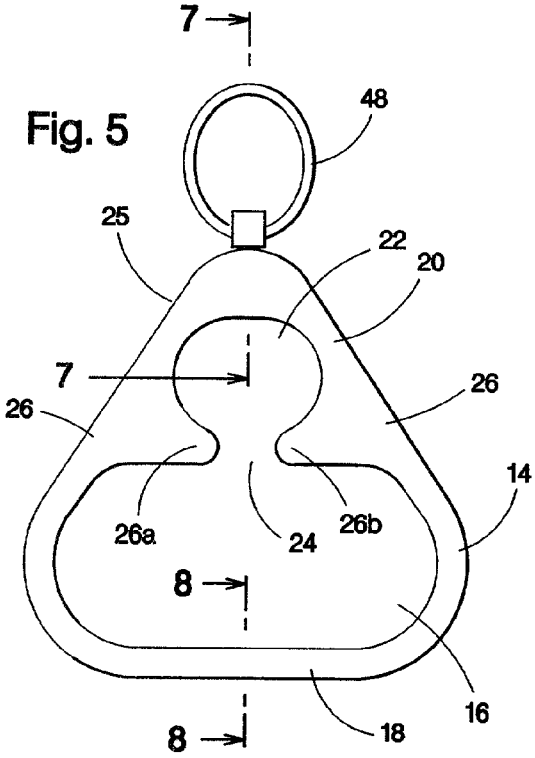
FIG. 5 is an elevation of a preferred embodiment of the cane holder of the invention similar to that shown in FIG. 1.

FIG. 3 is an isometric view of an alternative embodiment of the cane holder of the invention in which the same structure as those shown in FIGS. 1 an 2 are designated by the same reference numerals and similar but somewhat different structures are designated by the same reference numeral with the addition of a "c" to such reference numeral and in which the structure of the cane holder is generally similar to that shown in FIGS. 1, 2 and 5 except that the larger opening 16*c* of the cane holder constituting more than one-half of the entire cane holder ring 18*c* has a more round or oval configuration generally similar to that of the smaller opening 22*c* rather than having an oblong configuration with a significant dimension from side to side as shown in the opening 16 of FIG. 1. The operation of the holder is essentially the same, however, as that shown in the earlier figures, except that the larger opening 16*c* because of its configuration will generally not be as resilient as the opening 16 in FIG. 1 so that it cannot be stretched as much to pass over a large cane head. On the other hand, the more compact and rounded configuration of the ring 14*c* is more effective to grip a large shaft of a cane and also maintain the side extensions 26*a* and 26*b* closely opposite to each other and provide more stiffness so far as resisting the passage of a cane shaft between such extensions is concerned. Once the cane shaft is forced through the interconnecting opening 24*c*, however, the operation is the same.

The lanyard in FIG. 3 has a somewhat different construction from that shown in the previous figures, but could be exactly the same as shown previously in FIG. 1. For distinction between the lanyard parts shown in FIGS. 1 and 3, the reference numerals applied to the same parts and structures in FIG. 3 as in FIG. 1 are, as noted above with respect to the cane holder 10, the same and in FIG. 3 where similar parts may be somewhat different, but serve similar functions, the reference numerals are identified further by the reference "c" added to such reference numeral.

In FIG. 3, the cane holder 10*c* of the invention is provided with a woven plastic or other suitable lanyard 27*c* having an outer or top section 28*c* and a lower or inner section 29*c* where the two ends 21 and 23 of the lanyard material may be stitched together at 32 and attached to a releasable snap fitting 39*c* similar to the snap hook 39 shown in FIGS. 1 and 2. The lanyard 27*c* is also provided with a connecting snap fitting 34*c* such as shown in further detail in FIGS. 22 and 23. This fitting is provided with finger release buttons 85 to bias spring arms 84*a* and 84*b* inwardly when either securing the snaps or in releasing them (see FIGS. 22 and 23) and if desired may have the end interengaging seats 90 and fingers 92 tapered as shown so that the snaps will automatically open upon the exertion of a few pounds tension in case the lanyard snags upon an external object.

Lanyard 27*c* may also include a means 36*c* for adjusting its length, such that the position of holder 10 may be easily adjusted by users requiring different positions or lengths depending upon the user's height and/or other proportions and the cane being used. Such means 36*c* for adjustment is shown conventionally as a snap connection, but may comprise any suitable adjustment means which enables portions of the lanyard to be doubled over and held in adjacent layers or which provides for inserting or removing short lengths of lanyard material to adjust the overall length. Thus, in FIG. 3 it may be understood that the means 36*c* is essentially a connector at which two sections of the lanyard may be separated and a short extension piece, not shown, inserted to lengthen the lanyard if necessary. A further plastic buckle or connector 39*c* is, as indicated above, preferably secured to the lowest end of the lanyard 28 extending from first and second ends 21 and 23 for detachably connecting the lanyard 27*c* with the cane-engaging outer ring member 12*c* of the cane holder 10*c*. Such buckle could also have a breakaway construction, but this is normally not necessary in view of the breakaway construction of the fitting 34*c*. Usually this buckle 39*c* will incorporate a snap connection as shown for the connection 39 in FIG. 1.

FIG. 3 also shows a cane 40 referred to above, which for illustrative purposes is a so-called swagger stick having a bulbous or hemispherical top or hand grasping portion 42 and an elongated slightly tapered straight shaft 44, only the upper portion of which is shown. It will be noted that the opening 16*c* in the center of the arcuate section 14*c* is somewhat larger in longitudinal dimension and smaller in transverse dimension than the bulbous head 42 of the cane, while the opening 22*c* is smaller in all dimensions than the bulbous head 42. The interconnecting opening or passage 24*c* is, furthermore preferably more or less the same width as or slightly smaller than the upper diameter of the shaft 44 of the cane so that, while the cane shaft 44 is retarded in passage through said opening, it will nevertheless pass through with some exertion of force in line with the opening. The connecting ring 48 serves as a convenient rotatable connection of the buckle 39*c* and the head portion or ring mounting portion 25 of the holder 10 allowing such cane holder 10 to be oriented in a more or less horizontal disposition while entering and removing the cane 40 into and from the cane holder.

The cane 40 is shown in full lines extending through orifice or opening 16*c* in FIG. 3 in the position it might be found immediately after being placed in such orifice by slipping the cane head 42 through the orifice 16*c* from the bottom, expanding the opening if necessary, or less preferably slipping the bottom of the cane into orifice 16*c*. In other words, the cane can be slid from either end into the opening or orifice 16*c*. Cane 40 is also shown in FIG. 3 in broken lines positioned within orifice 22*c* after having been slid transversely through the constricted opening 24*c* into the orifice 22*c* where it is confined by side pressure from the sides of the orifice and by the inability of the head 42 of the cane to pass downward through said orifice 22*c*.

Figure 4:
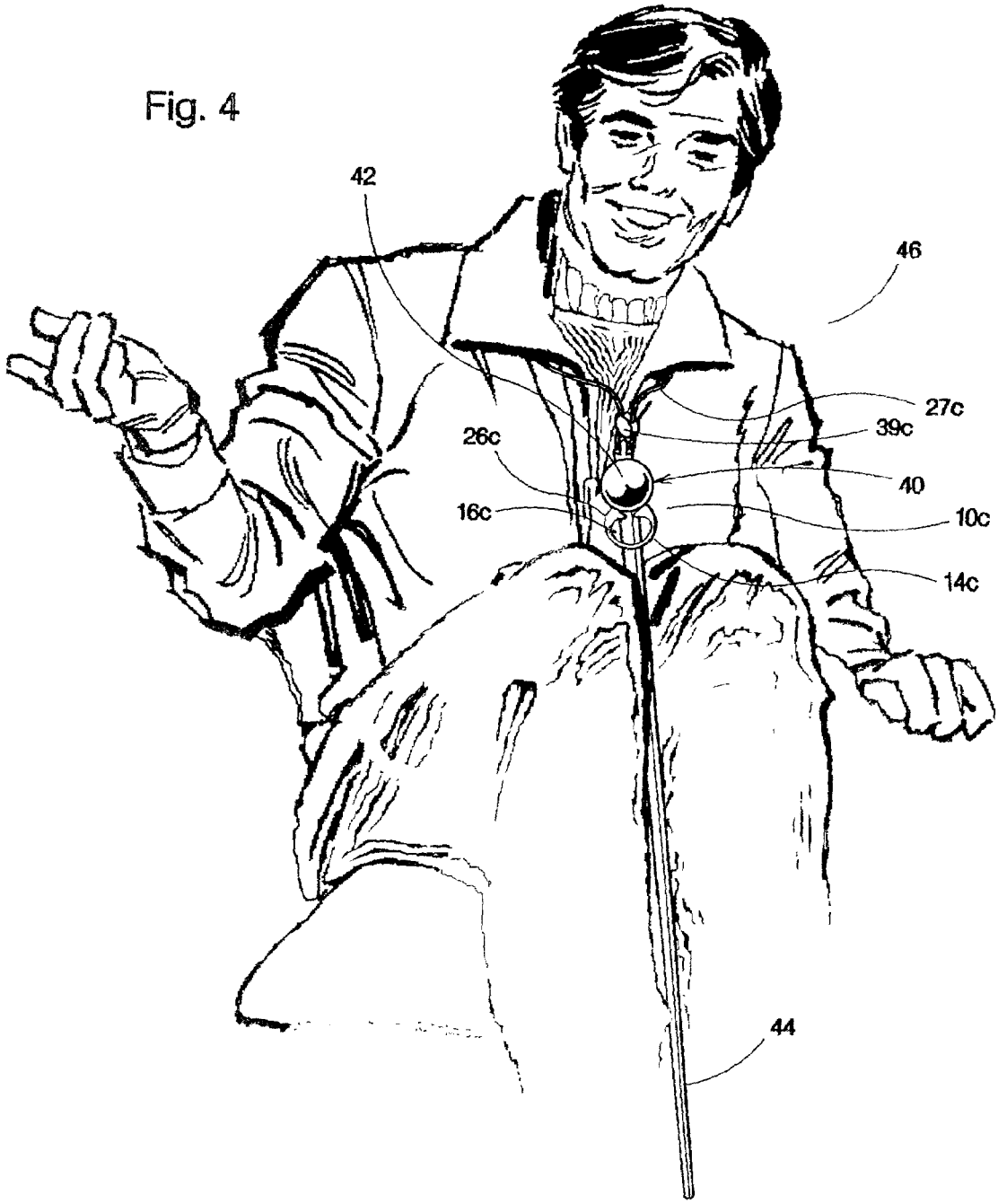
FIG. 4 is an isometric view of the alternative embodiment of the cane holder of the invention shown in FIG. 3 with the cane being supported by such holder while the user is in a seated position.

FIG. 4 shows the cane holder 10*c* shown in FIG. 3 being worn by a cane user 46 slung or placed about the neck of such user, in the present instance such user being shown seated on a support, not shown, that could be either a chair, a stool, a ledge, a bench, or any other support surface adaptable for or capable of supporting the human body and positioned at an appropriate height to support the body of the user in a reasonably comfortable position with his or her legs bent and resting on a surface not shown. As shown, the lanyard 27*c* is looped around the neck of the seated figure with the cane holder supported on the chest of the figure of the cane user 46. The two loops 14*c* and 20*c* (which is obscured by the head 42 of the cane) of the holder 10*c* define the lower and upper openings 16*c* and 22*c* (also obscured) which are shown with cane 40 passing through a portion of the upper or smaller opening 22*c* (obscured) and as will be understood resting upon the lower portion of the smaller loop 20*c* at the mouth of the interconnecting passage 24*c* which is visible in FIG. 4, but unnumbered because of the small scale. It will be understood that the relative dimensions of the cane and cane holder are the same in both FIGS. 3 and 4. It will also be understood that the cane has been placed in the cane holder in the case shown in FIG. 4 in one of three ways: (a) it may have been slid, bottom of the cane first, directly into the smaller opening 22*c*, which is obscured in FIG. 4, but visible in FIG. 3, in which case it is now retained in such opening by the larger head or hand grasping portion 42 of the cane being too large to pass through the opening or by the increasing size of the upper portion of the cane shaft becoming wedged in the smaller holder opening, (b) it may have been inserted into the larger opening 16*c* with the bottom end of the cane entered first and then slid sidewise through the interconnecting passageway 24*c* into the smaller opening 22*c* (see FIG. 3), and (c) the bulbous head 42 of the cane may have been passed through the larger opening or orifice 16*c* defined within the outer plastic section 14*c* from the bottom side of the holder 10*c* and the shaft of the cane then moved laterally through the passageway 24*c* until the cane shaft is contained within the smaller orifice 22*c*, which is obscured in FIG. 4, within the inner plastic section 20*c* (see FIG. 3).

As noted in connection with FIG. 3 as well as FIGS. 1 and 2, the head 42 of the cane 40 is too large to pass through the smaller opening 22 of the cane holder and the shaft 44 can preferably only be passed through the interconnecting passageway 24*c* by resiliently deforming or expanding the sides 26*a* and 26*b* of the passageway 24*c*. In order to allow such expansion, the holder 10 or 10*c* is formed of a stiff yet resilient material preferably having a smooth reasonably slippery or non-adherent surface which allows passage of the cane shaft with minimum resistance once the material of the holder 10 or 10*c* is deformed. The material of construction of the cane holder 10 or 10*c* must be such as to return to its original configuration once it has been deformed, and the deformation force exerted by the sides of the cane against the sides of the passageway removed. It has been found that low density polyethylene serves as a very satisfactory medium of construction. This plastic formulation is strong yet resilient, can be provided with a smooth surface and can be provided in various colors and has very satisfactory resilience characteristics for use in the cane holder. Various degrees of resilience or stiffness can be provided by different formulations of the material of construction. For example, a fairly young, vigorous user will be able to easily deform the material of construction to either bring the shaft of the cane 44 through the restricted passageway 24 or 24*c*, or in a preferred operation force the large arcuate section or opening 16 or 16*c* over the head 42 of a cane that is larger than the larger opening. The stiffer and more resistant the material of construction of the holder, the more securely the cane will be held once entered into the opening in which it is to be held. A more elderly user such as, for example, the proverbial little old lady, on the other hand, may not have the physical arm or hand strength to force the material of the holder over relatively large sections of a cane, and in such case a more resilient material forming a more flexible holder can be provided. Thus, as will be seen, a maker and distributor of the cane holder of the invention may prefer to supply a series of cane holders in accordance with the invention having a range of flexibilities and colors. In each case, the material of construction should have sufficient flexibility to be deformed by the strength of the user in order to pass an oversized cane shaft through the opening 24 or 24*c* or an oversized cane head through opening 16 or 16*c* and then return promptly to the design dimensions of the cane holder.

Figure 6:
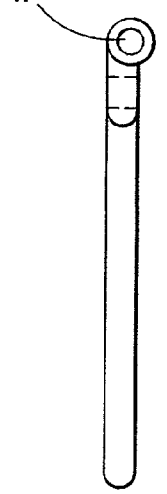
FIG. 6 is a side view of the preferred embodiment of the invention shown in FIG. 5.
Figure 7:
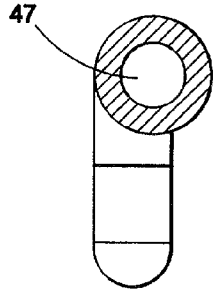
FIG. 7 is a cross-section of the cane holder along section 7—7 of FIG. 5.
Figure 8:
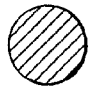
FIG. 8 is a cross-section of the cane holder along section 8—8 of FIG. 5.

FIG. 5 is an elevation and FIG. 6 is a side view of a preferred embodiment of the invention in which the configuration of the cane holder 10 is similar to or essentially the same as that shown in FIGS. 1 and 2. FIG. 7 is a cross-section of such cane holder along section 7—7 of FIG. 5, which constitutes the ring mounting section 25 of the cane holder 10, and FIG. 8 is a cross-section 8—8 through FIG. 5. In these sections, the opening 47 at the top receives the support ring 48 shown particularly in FIG. 1 and in FIG. 5 in broken lines as it passes through similar openings in the attachment at the end of the cane holder 12 in order to attach the buckle or snap fastening 39 of the lanyard 27 to the cane holder. In FIG. 5, the top or inner cane accommodating orifice 22 may be desirably about 1.25 inches in diameter, while the lower or outer orifice cane accommodating orifice_16 may be about 1.50 inches in its shorter dimension and 3.25 inches in its longer dimension depending, however, upon the expected range of cane shafts that are to be handled. As indicated above, it is expected that at least one of a set of three cane holders in accordance with the invention with progressively smaller orifices 16 and 22 or 16*c* and 22*c* should be able to accept almost any cane made. Thus, one in possession of three identical cane holders except for the respective sizes of the orifices 16 and 22 or 16*c* and 22*c* should be able to suspend on their person almost any cane presently made. In such case, the difference in relative sizes of the cane accommodating orifices from one holder to the next may be assumed to be about one-half inch or, in other words, a one-half inch differential between the orifice sizes provided in each succeeding cane holder. It will be understood, however, that only a serious collector of canes is likely to have more than one cane holder in accordance with the invention.

FIG. 9 is an elevation and FIG. 10 is a side view of the embodiment of the cane holder of the invention shown in FIGS. 3 and 4 in which there are essentially two adjacent more or less circular openings 16*c* and 22*c* within the outer ring members 12*c* overall and 14*c* and 20*c* designated separately. FIG. 11 is a section 11—11 through FIG. 9, and FIG. 12 is a section 12—12 through FIG. 9 similar to FIGS, 6, 7, and 8 with respect to FIG. 5. In FIG. 9, the upper opening 22*c* may be about 1.25 inches in diameter while the lower opening 16*c* may be about 1.75 inches in diameter, depending, however, upon the expected range of cane shafts that the holder is intended for.

Figure 18:
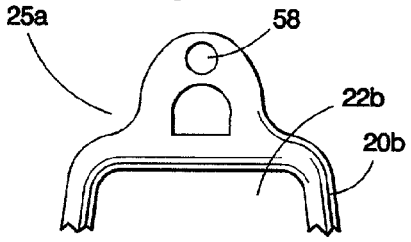
FIG. 18 is an elevation of an alternative upper section construction for the ring mounting section or portion of the holder shown in FIG. 13.
Figure 19:
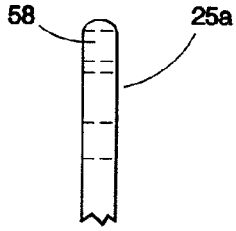
FIG. 19 is a side view of the alternative top on a ring mounting section of the holder shown in FIG. 13 as shown in FIG. 18.

FIG. 13 is an elevation of a lesser-preferred cane holder in accordance with the invention in which the upper portion of the holder including the upper opening 22*a* as shown takes a more rectangular configuration. In such configuration, the upper orifice is almost as wide as the lower orifice, but is by no means as high. Nevertheless, a cane shaft that slides easily in the lower opening 16*a* will be tightly held in the upper opening 22*a*. FIG. 14 is a side view of the construction of the holder of FIG. 13, while FIGS. 15, 16 and 17 are respectively sectional views of the construction of the cane holder at sections 15—15, 16—16 and 17—17 in FIG. 13. FIGS. 18 and 19 show a partial elevation and side view respectively of an alternative top design for the ring mounting section 25*a* of the holder shown in FIG. 13. In this further design the lanyard can be passed directly through the orifice 58 rather than through a secondary loop or ring.

The operation of the cane holder is as follows. First, the lanyard is placed around the neck of a wearer or cane user such that the first and second ends of the lanyard as well as the holding device hang in a vertical position over the chest of the owner or user, with the central portion of the lanyard positioned around the back of the neck of the owner or user. This can be done either by simply looping the lanyard over the head of the user, or particularly in the embodiment of the lanyard shown in FIGS. 1 and 2 adjusting the adjustment slip fitting 36 or in the embodiment shown in FIGS. 3 and 4, alternatively by unhooking the slip connection 36*c* on the lanyard and reattaching it around the neck of the user. However, it will be understood that the lanyard will usually just be looped over the head of the user. Normally, when the cane is in use, the head of the cane will, if possible, be urged through the outer loops 14, 14*c* or 14*a* of the various embodiments of the cane holder of the invention, and when the shaft of the cane has been received in the orifices 16, 16*c* or 16*a*, the shaft will then be forced transversely through the openings 24, 24*c* or 24*a* into smaller opening 22, 22*c* or 22*a* in which position either the shaft will be securely held or retained by the constricted size of the orifice or alternatively the cane head will be too large to pass or slip downwardly through the orifice in which the cane is contained, thereby supporting the cane as a whole. Alternatively, when the cane is not in use, the lower end of such cane may be passed or slipped through the outer or larger loops 16, 16*c* or 16*a* of holding device 10, 10*c* or 10*a*. Gravity will then urge the cane downwardly in the holding device, in effect causing the holding device to ride up along the shaft of the cane into snug engagement with the inner surface of the cane. Normally, this will occur generally near the upper section of the cane shaft, since most canes have a slightly enlarged central and upper diameter with respect to their lower diameter. Alternatively the head of the cane may be engaged by the loops 14, 14*c* or 14*a*. In either case before the cane becomes wedged into the opening 16, 16*c* or 16*a* of the holder by reason of contact of the holder with the upper shaft diameter or the head 42 of the cane, the cane shaft 44 may be moved laterally through the interconnecting opening 24, 24*c* or 24*a* into the inner smaller openings 22, 22*c* or 22*a* where its shaft may be wedged in place to hold the cane.

The frictional grip or, usually and more correctly, wedging engagement, of the holder with a cane should be sufficiently strong to prevent the cane from further sliding through the outer loop or orifice, thereby providing a simple holding device for firmly holding the cane when not in use and leaving the hands of the wearer or user free to perform other tasks. However, as explained above, if the diameter of the cane 40 is smaller than the inner diameter of the outer loop or orifice, as shown, for example, in FIG. 1, the cane can be simply pushed inwardly through passageway 24 into the inner loop or orifice 22, which has a smaller diameter and should frictionally grip the cane or effect wedging support of the cane at a level at which the cane becomes larger in diameter than the opening 22. If the shaft of the cane is relatively small, then the cane may be supported when the sides of the loop 20 engage the head 42 of the cane. Alternatively, if the cane has a horizontally disposed handle portion, the handle can be rested on the outer loop of the cane support, thereby still maintaining the cane in a generally vertical orientation. Frequently, the cane holder will be used when the user is in a sitting or resting position, and the cane will be resting in the holder between the legs and against the chest of the user. However, if such position is uncomfortable or inconvenient, the cane can be easily adjusted to either side of the user until it is ready to be used. When it is desired again to use the cane, it may be easily removed or released from the holder by gripping the holder with one hand and pulling the cane out of the holder. The flexible or elastic construction of the holder will allow the holding device to be twisted or flexed, thereby making it easier to remove the cane from the holder.

The cane, after being secured in the holding device of the invention, is held in close proximity to the body of the user, as shown in FIGS. 2 and 4. Such holder prevents the cane from falling or otherwise becoming disassociated from the user, and frees the hands of the user to perform everyday tasks while in a seated or even standing position, but wherein use of the cane is not required. The inventor also envisions that the lanyard which is secured around the neck of the user can be made in an infinite number of different patterns, shapes, styles and the like depending upon the particular tastes of the wearer. For example, the pattern can be chosen to match particular clothing colors or patterns, or may contain advertising material thereon for promotional reasons. In addition, the plastic cane-engaging holder itself can also be made in any number of colors either matching the lanyard or being a favorite color of the user. The simple construction of the holder, ability to accommodate canes of different shapes and sizes, and the ability to use various color combinations result in a holder having numerous advantages and improvements over known cane holders. In addition, the holder of the present invention can also be used to hold other devices having a similar shape or structure similar to a cane, such as an umbrella, parasol, or any other device which can be hooked or otherwise held onto or secured within the device.

While three very useful embodiments of the invention have been illustrated above, other arrangements may fall within the broad scope of the invention wherein interconnecting or intercommunicating orifices, one of which is preferably larger than the cane shaft and the other of which is preferably of lesser inside dimensions than the exterior of the cane shaft, are present. The invention may also be operative where the cane shaft is smaller than the diameter of either orifice as long as the head of the cane is larger than the smaller orifice or in which the cane shaft may actually be somewhat larger than the largest orifice (in which case the resilience or flexibility of the device will still allow it to be used as a holder, although less conveniently). The device may be made adaptable to a wider variety of canes by providing, as explained above, a greater number of interconnected orifices having increasing or decreasing dimensions from orifice to orifice.

Figure 20:
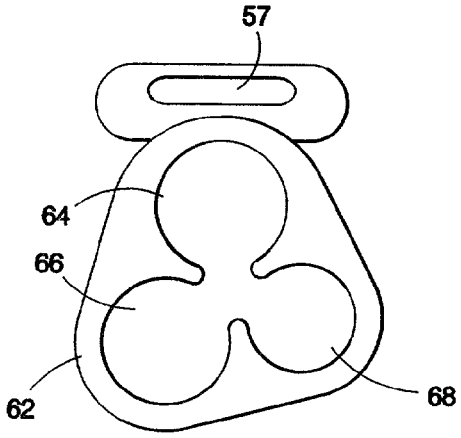
FIG. 20 is an elevation of a still further embodiment of the invention incorporating three interconnected orifices of gradually decreasing orifice size.
Figure 21:
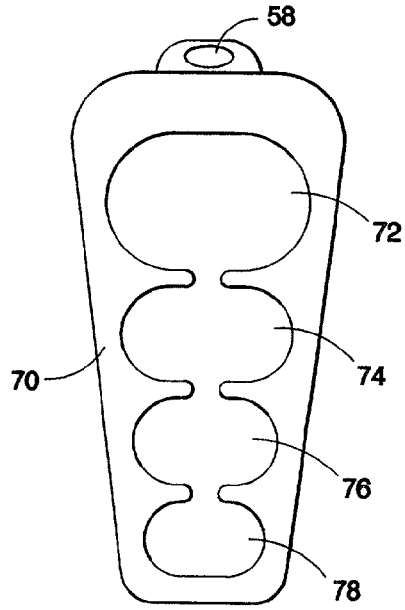
FIG. 21 is a still further alternative version of the invention in which a series of four gradually decreasing size orifices are provided in an elongated cane holder body.

FIGS. 20 and 21 are provided to illustrate the scope of the invention. In FIG. 20, a holder 62 having an outer configuration somewhat similar to that shown in FIGS. 1 and 5 is shown with, however, a tripartite inner orifice configuration rather than a bipartite configuration as shown in the earlier illustrated embodiment. The three separate but interconnected orifices 64, 66 and 68, of the tripartite orifice embodiment of FIG. 20 are of decreasing overall diameter so that a cane is normally first entered into the largest orifice 64 and then moved through the interconnecting openings into progressively smaller orifices until the one which most securely grasps or holds the cane is found. The movement will be, as readily seen from FIG. 20, normally from the largest orifice to the next largest orifice and then, if that does not fit snuggly about the cane, back through the central opening to the next largest opening of the holder 62. As will be evident from the drawing in FIG. 20, the smaller orifice 68 could also be positioned in the apex of the holder structure next to the lanyard opening 57, which would provide a more balanced holding arrangement where the cane shaft is fairly narrow and finally comes to rest or receives best support in the smallest orifice. However, if the cane is larger, then it will finally be stabilized or held in another one of the orifices in any event, so the order is perhaps not that important. The lanyard connection 57 could also be placed midway between the two smallest orifices so that whichever orifice the cane fitted the best would likely be toward the lanyard providing a slightly better balanced rest or holding position. The elongated shape of the lanyard opening 57 in FIG. 20 and also FIGS. 24 and 25 allows either a flat or a more rounded lanyard to be passed directly through the orifice as described with respect to FIGS. 18 and 19 which area adapted for a more or less round lanyard construction.

In FIG. 21, there is shown a further embodiment of the invention in which a progressive series of orifices are arranged serially in an oblong or elongated cane holder 70. Each of the more or less oval or laterally elongated orifices 72, 74, 76 and 78 are progressively smaller and each is interconnected with at least one other orifice beside it. As will be understood, a user will place his or her cane usually in the closest estimated diameter opening to the diameter of the cane or will merely place the cane first in the largest orifice, in this case 72, and then move it through the interconnecting orifices until it reaches one where it is securely held. As in FIG. 20, it will be understood that the progression of the orifices may be in the opposite direction with respect to the lanyard orifice 58, or the lanyard orifice may be disposed at one side of the holder instead of at one end. The lanyard orifice of this embodiment is designed more for use with an attachment ring as shown in FIGS. 1, 3 and 5, or as shown in FIGS. 18 and 19 with either a ring or more usually a round lanyard, as the orifice is more like that shown in such figures.

Figure 22:
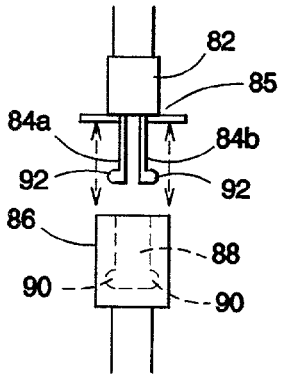
FIG. 22 is a diagrammatic view of a simple snap-type connector for convenient fastening and unfastening of the strap or lanyard to the cane holder of the invention.
Figure 23:
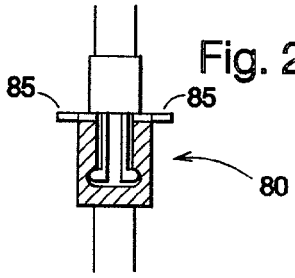
FIG. 23 is a diagrammatic view of the snap-type connector of the invention in buckled, connected or closed position.

FIG. 22 is a diagrammatic view of a snap connector of a common variety such as might be used as the connection 34*c* shown in FIG. 3, shown in FIG. 22 as unlatched. In FIG. 22, one section of the overall buckle or connector 80 (see FIG. 23) is provided on one half 82 with two oppositely deviated springs or flexible arms 84*a* and 84*b* that slide into chamber 88 on the opposite buckle or connector half 86 provided with an opening 88 having two undercut sections 90 into which protrusions 92 on the spring arms 84 slide when the connector is buckled or snapped together as shown in FIG. 23. As will be understood, the resilience of the spring arms plus the cooperation of the protrusions 92 in the undercut section 90 when buckled or snapped together will couple the two halves 82 and 86 of the connector 80, and hold the two ends of the lanyard together. Pressing upon the two release arms 85 will allow the spring catch to be either attached or detached. Furthermore, if the seats 90 and spring detents 92 are tapered on their upper edges, the connector can be made to be self unlocking at any force desired, dependent upon the angle selected. This arrangement guards against any accidental catching and possible pinioning or dragging of the wearer of the cane holding device of the invention on moving vehicles, machinery or the like by snagging of the lanyard or the cane holder itself. As will be understood, any other disconnect can be used, such as the simple compression sleeve disconnect shown in FIG. 1, or any other suitable disconnect can be used.

Figure 24:
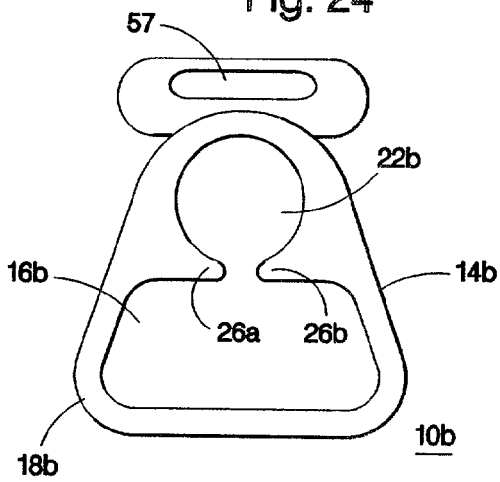
FIG. 24 is an elevation of a modified version of the cane holder invention shown in FIG. 7, but with a different configuration to the ends of the larger orifice and a laterally extended lanyard connector loop suitable to incorporate either a flat or round lanyard structure.

A further embodiment of the invention is shown in elevation in FIG. 24. In this embodiment, a preferred design for which is shown in FIG. 5, a lower or outer orifice 16*b* is substantially oblong with slanting angular ends and arcuate corners and extends within an outwardly flaring section 14*b* of a cane holder 10*b* at the upper end of which is a second smaller more rounded orifice 22*b*. The two sides of the orifice 22*b* are generally either round as shown or otherwise arcuate, which configuration tends to center and hold by actual side contact with the cane holder a wider variety of cane shafts. The wide side-to-side extension of the orifice 16*b*, which rather than having an arcuate shape as shown in FIG. 7, takes the form of the ends of a slanted rectangle, allows the head of an English walking cane having a conventional top cross piece to be slipped through the orifice with first one side or end of the handle inserted through and the shaft moved against the side of the orifice, and the other side or end of the handle then slipped through the orifice, if necessary stretching the side of the holder structure or plastic. The same is true with respect to a curved top cane. The additional size of the orifice also allows the outer orifice to be more easily stretched also to slip over or around the head of a swagger stick or ornate, carved or other more massive walking stick or cane head. The large size of the orifice 16*b* and thinner outer section of plastic 18*b* surrounding the orifice 16*b* in general allows greater stretching of the plastic section surrounding the orifice in order to fit over sections of cane which might otherwise not normally be insertable in the orifice. The embodiment shown in FIG. 24 shows a side-to-side opening 57 at the top of the cane holder for attachment directly to a flat lanyard if desired. An intermediate attachment ring such as shown in other figures could pass through such opening also.

The more convenient, but also more complicated side-to-side ring attachment as shown in other figures, such as FIGS. 1, 3, 5, 9 and 13 heretofore described is usually a preferred embodiment. The use of the ring allows the cane holder to lie flat against the body when supported from a lanyard. However, the side-to-side opening to receive the lanyard directly as shown in FIGS. 20, 21, 24 and 25 or, as a variation, FIGS. 18 and 19 could also be used.

Figure 25:
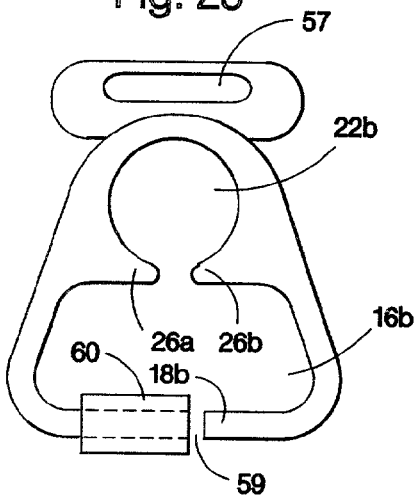
FIG. 25 is an elevation of an alternative version of the cane holder of the invention in which the entire holder is expanded outwardly about the larger orifice section as shown in FIGS. 5 and 24 but in which the larger opening may be further accessed through a sliding spring biased closure at one side and also including the laterally extended lanyard connector loop shown in FIG. 24 to accommodate a flat lanyard.

FIG. 25 is an elevation of a further embodiment of the cane holder of the invention in which the outer more or less straight section 18*b* on one side of the larger orifice of the holder is bisected at 59. A cylindrical gate 60, which may slide over the opening and interengage with the opposite side is shown on this straight section. Such cylindrical gate 60 is shown partially retracted, but can, as will be understood, be slid over the opening to form a closed orifice. This arrangement provides considerable further convenience, since if the user of the cane wishes, rather than inserting a cane into the cane holder, either from the bottom or smaller end or over the top stretching the structure of the holder over the cane handle, such user can merely pull back the spring biased gate structure, i.e. slide the cylindrical section over the straight section of the holder and slide the cane into the opening through such opening. The slide gate will then spring back, confining the cane in the larger orifice 16*b* from which it can be moved to the smaller orifice 22*b* if necessary. It may be advisable when the gate 60 is provided to form the cane holder from a stiffer material so that the unconnected ends of the structure around the large orifice and particularly section 18*b* are more rigid, allowing more certain matching of the two ends when or as the slide gate 60 is closed. Since the gate is openable to insert a cane into the large orifice, the material of the holder may not need to be as flexible as otherwise, although the extensions 26*a* and 26*b* defining the interconnection between the two orifices should be relatively resilient to allow passage of a cane shaft between the two orifices. While the slide gate arrangement adds some complication to the cane holder arrangement of the invention, it also may be preferred by some users for convenience in initially entering the cane into the holding device of the invention.

As explained in detail above, the cane holder of the invention by its combination of the use of multiple intercommunicating orifices of different sizes, plus the use of a resilient plastic that does not have a significant long-term memory, but instead has essentially complete return to previous shape and form after being deformed, has provided a cane holder that is not only more efficient and effective than previous cane holders, but that can also be easily and simply produced for a minimum cost and essentially improve the quality of life for the users of canes. As indicated above, by the use of about three different basic sizes of the cane holder of the invention one may provide for holders for virtually every size and shape of cane normally made. In addition, the embodiment of the invention shown in FIGS. 1, 2 and 5, as well as 24 and 25, by the provision of a larger oblong initial cane receiving orifice, very considerably increases the ability of the cane holder of the invention to adjust to odd shapes and sizes and particularly large diameter handles and shafts of canes. As indicated above, by the use of about three different basic sizes of the cane holder of the invention one may provide for holders for virtually every size and shape of cane normally made.

Normally the average cane user will select a holder in the middle of the range for the cane or canes in use by that user. Most cane users have, at the most, only two or three canes which tend, or the canes they actually use tend, to be fairly similar in size. Some users of canes, however, tend to collect all sorts of canes and these users, or collectors, may require several of the basic cane holders of the invention in different sizes. However, the improved embodiment of the invention shown in FIGS. 20 and 21 have considerable more adaptability to various sized canes so that by use of such embodiment a much wider variety of canes can be adapted to a significantly greater variety of sizes and shapes of canes. As will be noted from FIGS. 1, 2, 5, 13, 24 and 25, the cane holding orifices do not need to be strictly round or oval, but can be of various internal shapes for additional flexibility in adaptation to canes of various types. The relatively thin side extensions between adjacent orifices as shown in FIGS. 20, 21, 24 and 25 also allow relatively large canes to be passed or pressed through the openings. However, in most cases the more sturdy but wider openings shown in FIGS. 1, 3, 5, 9 and 13 will be preferred between the inward extensions or expansions 26*a* and 26*b* denoted especially in FIG. 1 and forming in FIGS. 1, 3, 7 and 13 the openings 24, 24*c* and 24*a*, respectively.

It will be understood that various lanyards can be used with the cane holder of the invention. For example, the lanyard, either a flat lanyard or round lanyard, can be slipped directly through the lanyard openings shown in FIGS. 20, 24 and 25 and the lanyard ends bound or secured to each other by a plastic compression sleeve slipped over the ends. Such compression sleeve may be either rigid or flexible and could itself constitute an effective breakaway fitting or disconnect. The same arrangement may be used with the ring connection shown in FIGS. 1, 3, 5, 9 and 13. The breakaway aspect may also constitute a partial function of the connector or buckle 39*c* shown in FIGS. 3 and 4, which most preferably should also be easily disconnected so that the user of the cane holder can merely by pressing on an integral latch disconnect the lanyard from the cane holder, allowing the user to remove the cane holder from the lanyard, place the cane holder over the head of the cane, for example, or otherwise place the cane in the holder, secure the cane in the appropriate orifice in the cane holder and then reattach the cane holder to the lanyard so it will be available upon demand. This makes the cane holder even more convenient than it would otherwise be. The lanyard may also be provided with a slide adjustment, as shown in FIG. 1, that in effect determines the size of the neck opening in the lanyard. This will somewhat adjust the effective length of the lanyard without incorporating an actual length adjustment.

As indicated above, the cane holder of the invention is not only utilitarian and practical but also can be decorative. For example, the plastic holder itself can be formed from various colors of plastic not only in solid colors, but because of the shape of the holder of mixtures of colors such as swirls, multi-colors, and the like. In addition, the lanyard can be made in various decorator fabric designs and colors including color coordination with the outfit of the user.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

I claim:

1. A cane holder comprising:

(a) a flexible support strap having first and second terminal ends for positioning about the body of a cane user, (b) a cane-engaging member secured to the support strap, said cane-engaging member having at least two interconnected openings of disparate size for adjustable support of a cane in a substantially vertical position on the person of a user.

2. A cane holder in accordance with claim 1 in which the cane-engaging member is formed from a resilient material that can be distorted to allow placement therein of a cane having a shaft dimension larger than the interconnection between the at least two interconnected openings.

3. A cane holder in accordance with claim 2 wherein the interconnection between the two interconnected cane openings is characterized by flexible protrusions between which a cane shaft may be laterally passed.

4. A cane holder in accordance with claim 2 in which there are more than two interconnected disparate-sized openings.

5. A cane holder in accordance with claim 2 wherein the largest opening is of elongated shape with at least one relatively thin flexible side.

6. A cane holder especially for support from the person of the user comprising:

(a) a three dimensional plastic member having greater lateral dimensions than thickness dimensions, (b) at least two differentially sized orifices arranged side-by-side and in direct communication with each other through an intervening passageway such that a cane positioned in a larger of the at least two differentially sized orifices can be passed laterally directly from the larger of the at least two orifices into a smaller of the at least two orifice, (c) the plastic member being composed at least at the sides of the intervening passageway of a flexible polymer that can be deformed sufficiently to allow passage of a cane from the larger differentially sized orifice to the smaller orifice of the at least two differentially sized orifices when the cane is larger than the interconnecting passage, and (d) means to retain the plastic member at least temporarily connected to the body of a cane user.

7. A cane holder in accordance with claim 6 wherein there are more than two differentially sized interconnecting orifices in the three dimensional plastic member.

8. A cane holder in accordance with claim 6 wherein the means to retain the plastic members on or about the person of the cane user is a lanyard.

9. A cane holder in accordance with claim 8 wherein the lanyard is provided with a breakaway feature for reasons of safety.

10. A cane holder in accordance with claim 9 wherein the breakaway feature is comprised of a connector disengagable upon the application of a predetermined tension.

11. A cane holder in accordance with claim 6 wherein the larger of the at least two differentially sized orifices has significantly greater dimensions in one lateral direction than transverse thereto.

12. A cane holder in accordance with claim 11 wherein the dimensions of plastic along at least one side of the larger orifice are dimensioned to allow greater flexibility in the dimensions of such orifice.

13. A cane holder in accordance with claim 6 additionally including a gate in the exterior wall of at least one orifice to allow lateral admission of a cane to such orifice.

14. A cane holder in accordance with claim 13 wherein the gate is a sliding gate structure.

15. A method of storing a cane temporarily while the user is otherwise occupied comprising:

(a) placing the cane in a holder having at least two disparate sized interconnecting orifices in the general range of sizes of the cane shaft diameter, (b) said cane being entered into the larger of the disparate sized orifices with an endwise orientation, (c) moving the cane laterally through the interconnection between the orifices into the smaller of the orifices where the cane is retained by side contact with the cane holder structure, (d) allowing the cane to remain in such smaller sized orifice until required and then removing for further use.

16. A method of storing a cane in accordance with claim 15 wherein sufficient force is applied to the cane to force it from a larger looser fitting orifice into a smaller more tightly fitting orifice through a relatively small-sized interconnecting passage by force sufficient to temporarily deform the composition of the holder.

17. A method of storing a cane in accordance with claim 16 wherein the cane after passage into the smaller of the orifices is allowed to be retained therein with a loose fit about the cane with the head at the upper end of the shaft of the cane unable to pass through the orifice as the result of a differential size between the orifice and at least one dimension of the head of the cane.

18. A method of storing a cane in accordance with claim 16 wherein the cane is allowed to be retained by close contact of the orifice sides with at least two points on the sides of the shaft of the cane as a reaction against initial forceful movement of the cane into the orifice.

* * * * *